United States Patent [19]

Egolf et al.

[11] Patent Number: 4,934,980

[45] Date of Patent: Jun. 19, 1990

[54] NOVELTY MUSIC BOX

[76] Inventors: Harry S. Egolf; Madeline F. Egolf, both of 2048 San Tomas St., Fairfield, Calif. 94533

[21] Appl. No.: 406,022

[22] Filed: Sep. 11, 1989

[51] Int. Cl.[5] ..... A63H 33/00; A63H 3/28; A63H 13/20; A63G 31/00

[52] U.S. Cl. ..... 446/297; 446/29; 446/485; 272/1 D; 272/31 R; D17/24; D21/64

[58] Field of Search ..... 446/297, 29, 265, 268, 446/298, 299, 302, 303, 404, 409, 485; 272/1 R, 1 D, 52, 52.5, 53.1, 53.2, 27 N, 31 R; D17/24; D21/64, 115

[56] References Cited

U.S. PATENT DOCUMENTS

| | | | |
|---|---|---|---|
| D. 247,688 | 4/1978 | Nakao et al. | D17/24 |
| D. 282,263 | 1/1986 | Ahn | D17/24 |
| D. 282,473 | 2/1986 | Catelli | D17/24 |
| D. 286,796 | 11/1986 | Simmons | D21/64 |
| 2,302,239 | 11/1942 | McKinney | 272/52 |
| 2,484,895 | 10/1949 | Links | 446/297 X |
| 3,349,661 | 10/1967 | Searls | 84/94.2 |
| 3,779,124 | 12/1973 | Christensen | 446/404 X |
| 4,050,342 | 9/1977 | Suzuki et al. | 446/298 X |
| 4,373,715 | 2/1983 | Henn | 272/1 R |
| 4,545,775 | 10/1985 | Kim | 446/299 |
| 4,820,229 | 4/1989 | Spraggins | 446/485 X |
| 4,858,079 | 8/1989 | Ohashi | 446/485 X |

FOREIGN PATENT DOCUMENTS

| | | | |
|---|---|---|---|
| 1283722 | 11/1968 | Fed. Rep. of Germany | 446/409 |
| 1137119 | 5/1957 | France | 446/268 |
| 591313 | 8/1947 | United Kingdom | 272/1 R |

*Primary Examiner*—Robert A. Hafer
*Assistant Examiner*—D. Neal Muir
*Attorney, Agent, or Firm*—Leon Gilden

[57] ABSTRACT

A novelty music box is set forth wherein a deer-like configuration is provided with a bifurcated forward plate, a bifurcated rear plate, and a central torso, with a deer-like head outline secured to an uppermost portion of the forward bifurcated plate. A mechanical sound-generating music box is secured to the forward plate within the torso and includes a hollow shaft extending through the music box and directed exteriorly thereof through the head-like outline terminating in a glove containing a luminescent bulb therewithin. The luminescent bulb is intermittently actuated by use of a sprocket secured to a rear terminal end of the shaft that intermittently engages a spring finger to create intermittent illumination of the bulb.

6 Claims, 1 Drawing Sheet

NOVELTY MUSIC BOX

BACKGROUND OF THE INVENTION

1. Field of the Invention

The field of invention relates to sound generating devices, and more particularly pertains to a new and improved novelty music box wherein the same includes a deer-like, or more particularly a reindeer like, construction with a intermittently illuminating bulb positioned in a nose-like orientation relative to a forward face of the construction.

2. Description of the Prior Art

Musical boxes of various configurations and types are known in the prior art. The musical boxes are of a soothing and pleasingly enhancing construction utilized by individuals of all age groups. Melodies of various types are produced, dependent upon the intended nature of the music box, wherein the instant invention sets forth a "Rudolph the Red Nose Reindeer" like charicature, with an intermittently flashing bulb positioned as a nose of the organization. Examples of the prior art may be found in U.S. Pat. No. 3,849,66I to Scarls providing a rotating music box that revolves subsequent to a winding while playing a predetermined tune depicting a religious setting.

U.S. Pat. No. Des. 247,688 to Nakao; U.S. Pat. No. Des. 282,748 to Cattelli; U.S. Pat. No. Des. 282,268 to Ahn; and U.S. Pat. No. Des. 286,796 to Simmons each further illustrate various configurations of music boxes and the like for particular applications.

As such, it may be appreciated that there is a continuing need for a new and improved novelty music box which addresses the particular secular need for a soothing and character enhancing organization wherein the novelty music box of the instant invention substantially fulfills this need.

SUMMARY OF THE INVENTION

In view of the foregoing disadvantages inherent in the known types of music boxes now present in the prior art, the present invention provides a novelty music box wherein the same utilizes a tune in conformity with the construction of the music box with a visually intermittently illuminated bulb in conformity with the character of the reindeer-like construction of the box. As such, the general purpose of the present invention, which will be described subsequently in greater detail, is to provide a new and improved novelty music box which has all the advantages of the prior art music boxes and none of the disadvantages.

To attain this, the novelty music box of the instant invention includes a reindeer-like configuration formed with a bifurcated rear plate depicting rear legs, a bifurcated forward plate depicting forward legs, and a hollow torso orthogonally secured therebetween with a reindeer-like head secured to the forward bifurcated plate, wherein the head includes a rotating reindeer-like nose, particularly of a red coloration that is intermittently illuminated while simultaneously a predetermined tune particularly utilized, such as "Rudolph the Red Nose Reindeer", is generated by the musical sound generating box contained within the torso The illuminating bulb is secured to a shaft that is directed through the music box and terminates in a sprocket at a remote end of the music box to simultaneously wind the spring-like mechanical music box contained within the torso and enable rotation of a sprocket mounted on the rear terminal end of the shaft to engage a spring finger to effect intermittent illumination of the associated bulb.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved novelty music box which has all the advantages of the prior art music boxes and none of the disadvantages.

It is another object of the present invention to provide a new and improved novelty music box which may be easily and efficiently manufactured and marketed.

It is a further object of the present invention to provide a new and improved novelty music box which is of a durable and reliable construction.

An even further object of the present invention is to provide a new and improved novelty music box which is susceptible of a low cost of manufacture with regard to both materials and labor, and which accordingly is then susceptible of low prices of sale to the consuming public, thereby making such novelty music boxes economically available to the buying public.

Still yet another object of the present invention is to provide a new and improved novelty music box which provides in the apparatuses and methods of the prior art some of the advantages thereof, while simultaneously overcoming some of the disadvantages normally associated therewith.

Still another object of the present invention is to provide a new and improved novelty music box which provides visual and audible conformity to a reindeer-like theme suggested by the configuration of the organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2, 3, 4:
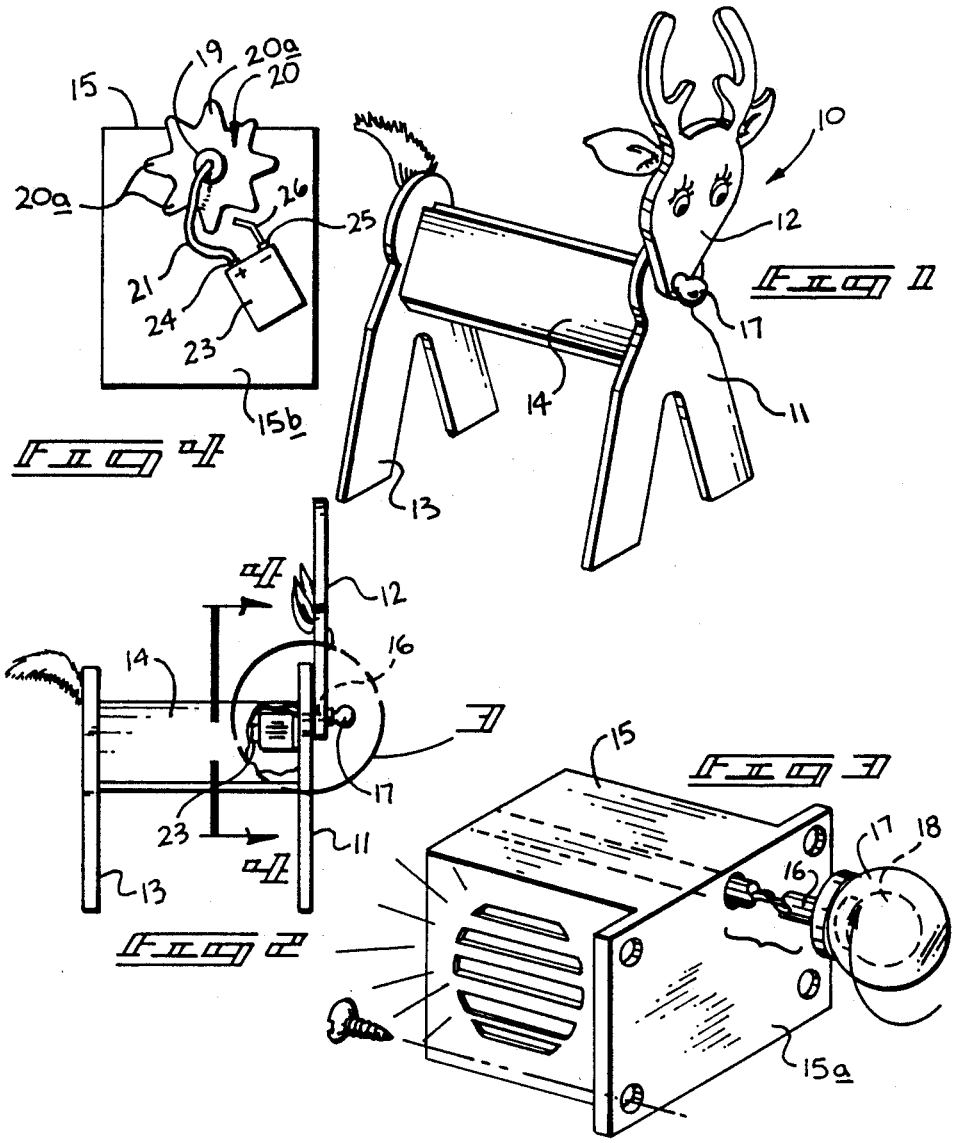
FIG. 1 is an isometric illustration of the instant invention.
FIG. 2 is an orthographic side view taken in elevation of the instant invention.
FIG. 3 is an isometric illustration somewhat enlarged, of the section as set forth in FIG. 2.
FIG. 4 is a rear isometric illustration of the section taken along the lines 4—4 of FIG. 2 in the direction indicated by the arrows.

With reference now to the drawings, and in particular to FIGS. 1 to 4 thereof, a new and improved novelty music box embodying the principles and concepts of the present invention and generally designated by the reference numeral 10 will be described.

More specifically, the novelty music box 10 of the instant invention essentially comprises a bifurcated forward board 11 spaced parallel to and forwardly of a bifurcated rear board 13 simulating leg pairs of the associated deer-like configuration, as illustrated in FIG. 1. A semblance of a deer-like head outline plate 12 is secured to an uppermost end of &he forward board 11 and provided with the geometric configurations conforming to ears, antlers, and a jaw outline. A torso body portion 14 is orthogonally joined to interior faces of each of the forward and rear boards defining an elongate cavity therewithin.

A music sound generating assembly 15 is positioned interiorly of the torso 14 and the cavity defined therewithin contained within a cabinet-like structure defining the assembly 15 formed with a forward face 15*a* defined by exteriorly depending flanges formed with apertures therewithin for securement to an interior surface of the forward board 11 and joined thereto in an orthogonal relationship relative to the longitudinal body of the assembly 15, wherein the assembly 15 is aligned with the forward board 11 and the head outline plate 12. The sound generating assembly 15 includes a mechanical sound generating device therewithin of a conventional spring powered device, as illustrated in U.S. Pat. No. 3,349,661 incorporated herein by reference. An elongate hollow shaft 16 of a predetermined length greater than that defined by the sound generating assembly 15 extends longitudinally thereof and extends through the forward board 11 and the head outline plate 12 with translucent globe 17 coaxially aligned onto a base portion mounted on the hollow shaft 16, wherein the hollow globe and its associated base are positioned in an orthogonal relationship relative to the exterior surface of the head outline plate 12, as illustrated in FIGS. 1 and 2 for example. The hollow shaft 16 is in mechanical communication with the spring motivated musical sound generating device positioned within the sound generating assembly 15 (not illustrated) in a conventional mechanical relationship. An electric light bulb 18 is mounted within the globe 17 and is typically of a red coloration consistent with the theme of the novelty music box 10 depicting a "Rudolph the Red Nose Reindeer" figure, as well as a comparable musical score to be provided by the musical sound generating assembly 15. The hollow shaft 16 extends through the music sound generating assembly 15 and terminates in a rear terminal end 19 that extends rearwardly and orthogonally relative to an exterior rear face 15*b* of the sound generating assembly 15 An electrically conductive sprocket 20 is fixedly mounted on the rear terminal end 19. A first and second respective electrical transmission line 21 and 22 extends through the hollow shaft 16 in communication with the electrical light bulb 18 within the globe 17 and extends exteriorly of the shaft 16 with the first electrical transmission line 21 secured to a positive terminal 24 end of an associated battery 28. The second electrical transmission line 22 is secured to the base of the sprocket 20. It should be noted that the sprocket 20 includes an insulative layer 20*a* to electrically insulate the sprocket 20 from the shaft 16. An "L" shaped contact spring finger 26 is secured to the negative terminal 25 of the battery 28 with an upper leg thereof positioned between the sprocket legs 20*a*, thereupon an unwinding and musical playment of the sound generating device within the assembly 15 effects rotation of the shaft 16 as well as the globe 17 and effects intermittent communication of the sprocket 20 with the contact spring finger 26 to effect intermittent illumination of the bulb 18. The overall effect is to provide a simulation of the fabled "Rudolph the Red Nose Reindeer" character.

As to the manner of usage and operation of the instant invention, the same should be apparent from the above disclosure, and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A novelty music box comprising, a forward first support plate spaced from a rear second support plate spaced from and parallel the forward support plate, and a further plate mounted upon an upper terminal end of the forward first support plate defining a deer-like configuration, and an elongate hollow torso defining an elongate cavity therewithin orthogonally mounted to confronting first and second interior wall surfaces of the first and second support plates respectively, and a music sound generating assembly means mounted within the cavity including a rotatably manually manipulatable shaft member extending through the sound generating assembly for providing a musical sound upon rotative winding and subsequent release of the shaft member.

2. A novelty music box as set forth in claim 1 wherein the shaft member extends through the sound generating assembly and extends exteriorly and orthogonally through the first plate and further plate and terminates at a forward end of the shaft member in a translucent globe containing an illumination bulb therewithin.

3. A novelty music box as set forth in claim 2 wherein the shaft member extends exteriorly through a rear face of the sound generating assembly and includes an electrically conductive sprocket mounted thereon, the electrically conductive sprocket including an insulative layer to electrically insulate the sprocket from the shaft member.

4. A novelty music box as set forth in claim 3 wherein the sound generating assembly is mounted to the first interior wall surface of the first support plate.

5. A novelty music box as set forth in claim 4 wherein the shaft member is hollow and includes a first and second electrical transmission line extending through the shaft member and secured to the illumination bulb at forward ends of the respective first and second electrical transmission lines, and wherein a rear end of the first electrical transmission line is in electrical communication with a first terminal end of a battery, and the second electrical transmission line is in electrical communication with the sprocket.

6. A novelty music box as set forth in claim 5 including an "L" shaped contact spring finger in electrical communication with a negative terminal of the battery at one end with an upper leg of the "L" shaped contact spring finger positioned between spaced teeth of the sprocket to effect intermittent electrical communication of the spring finger with the sprocket upon rotation of the shaft member subsequent to the rotative winding and subsequent release thereof.

* * * * *